US008083554B2

(12) United States Patent
McAlonis et al.

(10) Patent No.: US 8,083,554 B2
(45) Date of Patent: Dec. 27, 2011

(54) CONNECTOR ASSEMBLY HAVING A UNITARY HOUSING

(75) Inventors: Matthew Richard McAlonis, Elizabethtown, PA (US); Charles Dudley Copper, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 82 days.

(21) Appl. No.: 12/478,935

(22) Filed: Jun. 5, 2009

(65) Prior Publication Data

US 2010/0311278 A1 Dec. 9, 2010

(51) Int. Cl.
*H01R 13/40* (2006.01)

(52) U.S. Cl. ..... 439/733.1; 439/751; 439/885

(58) Field of Classification Search ..... 439/444, 439/733.1, 869, 885

See application file for complete search history.

(56) References Cited

U.S. PATENT DOCUMENTS

| | | | | | |
|---|---|---|---|---|---|
| 3,621,444 | A | * | 11/1971 | Max | 439/109 |
| 3,676,833 | A | * | 7/1972 | Johnson | 439/295 |
| 3,696,323 | A | * | 10/1972 | Kinkaid et al. | 439/525 |
| 4,415,220 | A | * | 11/1983 | Kant | 439/751 |
| 4,660,911 | A | * | 4/1987 | Reynolds et al. | 439/83 |
| 4,746,301 | A | * | 5/1988 | Key | 439/82 |
| 4,804,339 | A | * | 2/1989 | Cohen | 439/588 |
| 4,969,829 | A | * | 11/1990 | Sato | 439/83 |
| 4,996,766 | A | * | 3/1991 | Piorunneck et al. | 29/842 |
| 4,997,376 | A | * | 3/1991 | Buck et al. | 439/59 |
| 5,064,391 | A | * | 11/1991 | Buchter | 439/733.1 |
| 5,145,383 | A | * | 9/1992 | Bowen et al. | 439/78 |
| 5,263,882 | A | * | 11/1993 | Peterson | 439/733.1 |
| 5,692,928 | A | * | 12/1997 | Nelson et al. | 439/733.1 |
| 5,902,139 | A | * | 5/1999 | Peterson et al. | 439/79 |
| 5,931,686 | A | | 8/1999 | Sasaki et al. | |
| 6,106,308 | A | * | 8/2000 | Chen et al. | 439/79 |
| 6,261,132 | B1 | * | 7/2001 | Koseki et al. | 439/733.1 |
| 6,312,294 | B1 | * | 11/2001 | Lai | 439/692 |
| 6,422,878 | B1 | * | 7/2002 | Pape et al. | 439/78 |
| 6,551,115 | B1 | * | 4/2003 | Li et al. | 439/79 |
| 6,811,449 | B2 | * | 11/2004 | Yamashita | 439/733.1 |

(Continued)

FOREIGN PATENT DOCUMENTS

DE 2643158 * 7/1977

(Continued)

OTHER PUBLICATIONS

European Search Report, International Application No. EP 10 16 4894.

*Primary Examiner* — Neil Abrams

(57) ABSTRACT

A connector insert includes a unitary body, cavities extending through the body, and contacts. The body extends between mating and loading sides. The loading side is configured to engage a circuit board. The mating side is configured to mate with a peripheral connector to electrically couple the circuit board with the peripheral connector. The cavities extend through the body from the mating side to the loading side. The contacts are held in the cavities of the housing and protrude from each of the mating and loading sides to engage the circuit board and peripheral connector and to provide an electronic signal path between the circuit board and the peripheral connector. The contacts are loaded into the cavities through the loading side and retained in the body by an interference fit between the contacts and the body. The interference fit prevents the contacts from being removed from the body through the mating side.

15 Claims, 9 Drawing Sheets

U.S. PATENT DOCUMENTS

| | | | | |
|---|---|---|---|---|
| 7,033,229 | B2 * | 4/2006 | Tsuchiya | 439/733.1 |
| 7,044,805 | B1 * | 5/2006 | Huang | 439/676 |
| 7,270,573 | B2 * | 9/2007 | Houtz | 439/607.39 |
| 7,435,100 | B2 * | 10/2008 | Chang et al. | 439/66 |
| 7,458,828 | B2 * | 12/2008 | Pavlovic | 439/83 |
| 7,722,413 | B2 * | 5/2010 | Tonosaki | 439/751 |
| 2005/0266728 | A1 | 12/2005 | Houtz | |

FOREIGN PATENT DOCUMENTS

| | | |
|---|---|---|
| EP | 0455297 | * 11/1991 |
| FR | 2 745 122 | 8/1997 |
| GB | 2024539 | * 1/1980 |

* cited by examiner

CONNECTOR ASSEMBLY HAVING A UNITARY HOUSING

CROSS-REFERENCE TO RELATED APPLICATIONS

This application is related to co-pending U.S. patent application Ser. No. 12/478,918 (the "'918 application"). The '918 application was filed on Jun. 5, 2009, and is entitled "Connector Shell Having Integrally Formed Connector Inserts." The entire disclosure of the '918 application is incorporated by reference herein in its entirety.

BACKGROUND OF THE INVENTION

The subject matter herein relates generally to electrical connectors and more particularly to electrical contacts inserted into electrical connectors.

Aeronautical Radio, Inc. ("ARINC") is a commercial standards group governing connectors, connector sizes, rack and panel configurations, etc primarily for airborne applications. Connectors which conform to ARINC specifications are sometimes referred to as ARINC connectors or connector assemblies. The ARINC connectors include one or more ARINC receptacle modules or inserts. One example includes the known ARINC 600 receptacle module or insert that holds size 22 electrical contacts. The ARINC 600 size 22 receptacle module or insert holds 150 electrical contacts using a housing formed of multiple sections. Different sized ARINC connectors may include a different number of ARINC 600 receptacle modules. For example, the size 3 ARINC 600 connector holds 4 ARINC 600 receptacle modules with a sum total of 600 contacts.

FIG. 1 is an exploded view of a known ARINC 600 connector insert 700. The ARINC 600 connector insert 700 includes a body divided into a front section 702 and a rear section 704. In order to assemble the ARINC 600 connector insert 700, a contact retention clip 706 is loaded into the front section 702 for each of a plurality of contacts 708. The contact retention clip 706 is loaded into one of a plurality of cavities 710 that extend through the front section 702. The rear section 704 is then bonded to the front section 702. The rear section 704 includes a plurality of cavities 712 that correspond to the cavities 710 in the front section 702. The electrical contacts 708 then are inserted, one at a time, into the cavities 710, 712 in the bonded front and rear sections 702, 704. The retention clips 706 engage the contacts 708 to secure the contacts 708 in the front and rear sections 702, 704. The ARINC 600 connector insert 700 thus includes a relatively large number of parts that are individually assembled together.

The contacts 708 in the ARINC 600 connector assembly 700 are machined from a solid block of a conductive material. The selection of materials used to create the contacts 708 is limited because the contacts 708 are screw machined. Typically, lower conductive copper alloys are used in a screw machining process. The contacts 708 in the ARINC 600 connector assembly 700 thus are not machined from high conductivity copper alloys and typically are machined from another, less conductive metal or metal alloy that has better machinability characteristics when compared to the high conductivity copper alloys. After machining the contacts 708, the entire contact 708 typically is covered with a gold plating layer to inhibit corrosion and therefore improve the current carrying capability of the contact 708. The contacts 708 thus are manufactured with less conductive materials and are plated in a barrel plating process that results in plating the entire contact 708 with a relatively expensive plating.

A need therefore exists for an ARINC 600 receptacle that is more economically manufactured.

BRIEF DESCRIPTION OF THE INVENTION

In one embodiment, a connector insert is provided. The insert includes a unitary body cavities extending through the body and contacts. The body extends between mating and loading sides. The loading side is configured to engage a circuit board. The mating side is configured to mate with a peripheral connector to electrically couple the circuit board with the peripheral connector. The cavities extend through the body from the mating side to the loading side. The contacts are held in the cavities of the housing and protrude from each of the mating and loading sides to engage the circuit board and peripheral connector and to provide an electronic signal path between the circuit board and the peripheral connector. The contacts are loaded into the cavities through the loading side and retained in the body by an interference fit between the contacts and the body. The interference fit prevents the contacts from being removed from the body through the mating side. In another embodiment, another connector insert is provided. The insert includes a unitary body cavities longitudinally extending through the body and elongated contacts. The body extends between opposite mating and loading sides. The mating side is configured to engage peripheral connectors and the loading side is configured to engage a circuit board. The cavities longitudinally extend through the body from the mating side to the loading side. The cavities include an inner surface. The contacts are disposed in the cavities and oriented along longitudinal axes between opposite mating and mounting ends. The contacts include flanges extending from the bodies in opposite directions. The contacts include flange protrusions extending from the flanges to secure the contacts in the cavities by an interference fit.

DETAILED DESCRIPTION OF THE INVENTION

Figure 1:
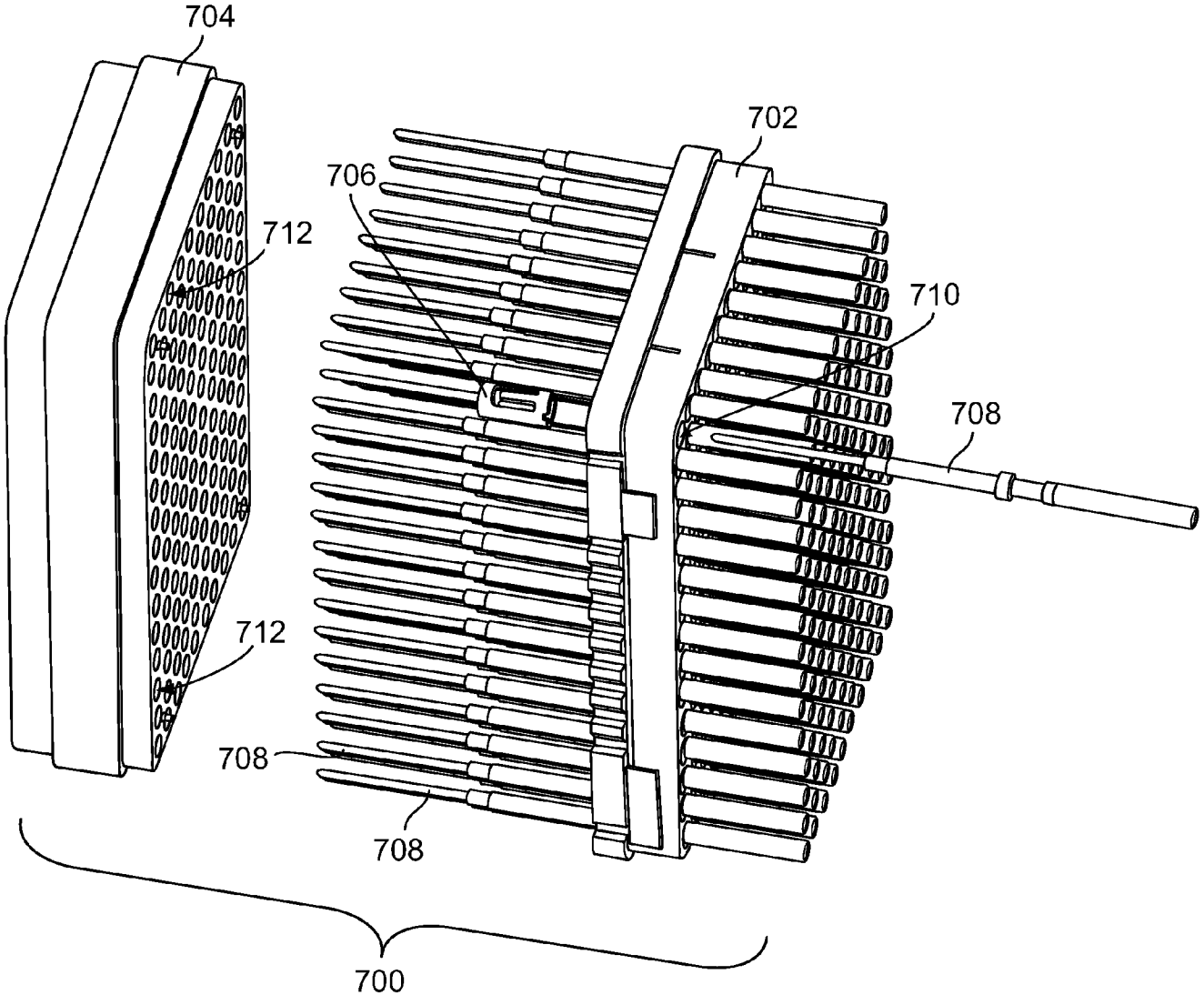
FIG. 1 is an exploded view of a known ARINC 600 connector assembly.
Figure 2:
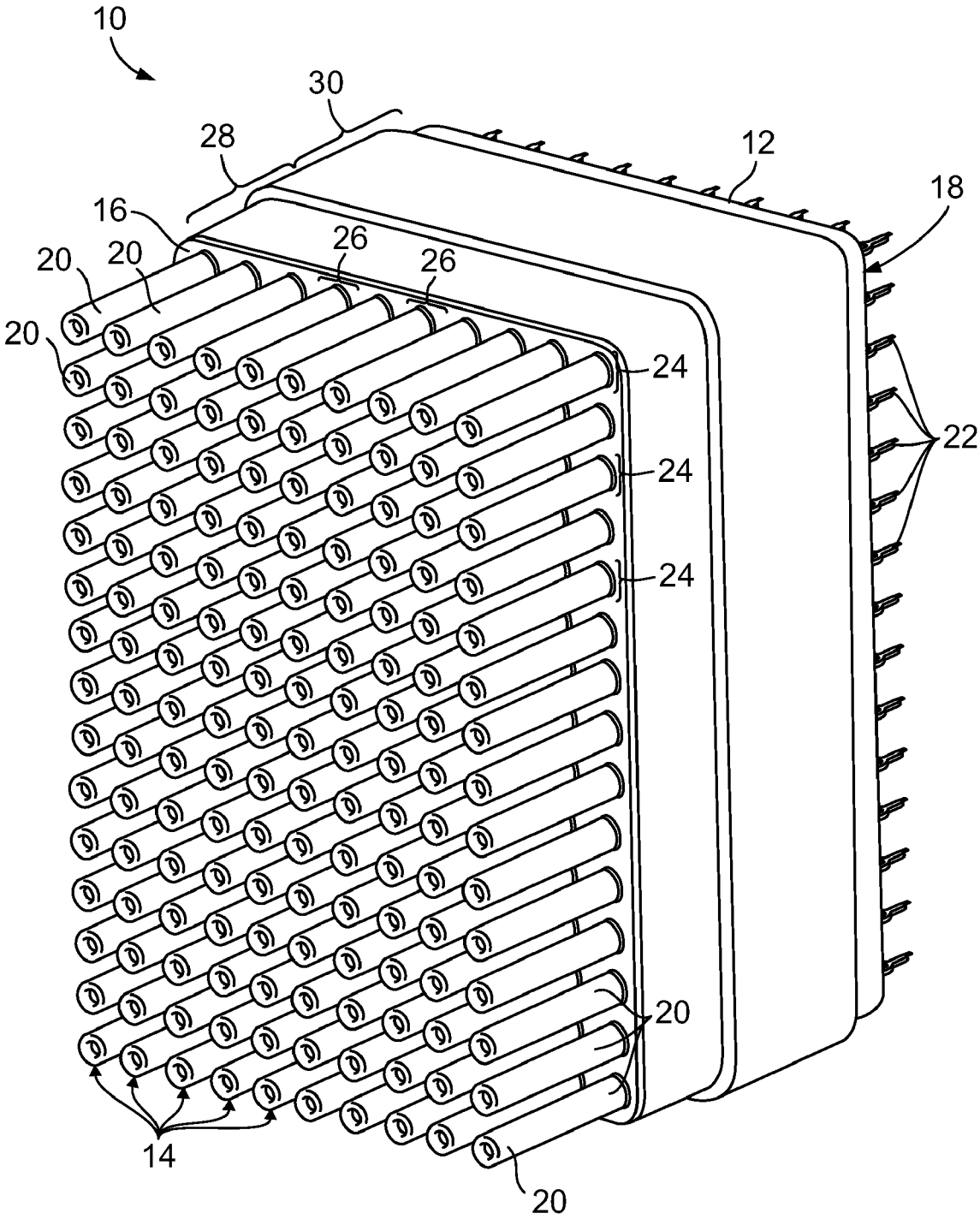
FIG. 2 is a front perspective view of a connector insert according to one embodiment.

FIG. 2 is a front perspective view of a connector insert 10 according to one embodiment. The connector insert 10 includes a body 12 that holds a plurality of electrical contacts 14. The body 12 may be formed of a single piece of material. For example, the body 12 may be molded as a single piece of dielectric material. In one embodiment, the body 12 is homogeneously formed as a single unitary body. Alternatively, the body 12 is divided into two or more pieces that are joined together. For example, the body 12 may include a mating section 28 and a mounting section 30. The mating and mounting sections 28, 30 may be molded as separate components and then secured together using one or more latches, threaded connections adhesives, and the like. The body 12 includes mating and loading sides 16, 18 disposed on opposite sides of the body 12. In the illustrated embodiment the mating and loading sides 16, 18 are in a parallel relationship with respect to one another. For example, the mating side 16 is approximately parallel to the loading side 18.

The electrical contacts 14 protrude from the mating side 16 and the loading side 18. A mating hood 20 of each electrical contact 14 protrudes from the mating side 16. As shown in FIG. 2, the mating hoods 20 are tube or cylinder-shaped components that extend from the mating side 16 in directions that are approximately perpendicular to the mating side 16. A mounting pin 22 of each electrical contact 14 protrudes from the loading side 18. As described below, the electrical contacts 14 are inserted, or loaded, into the body 12 through the loading side 18. In the illustrated embodiment, the connector insert 10 includes 150 electrical contacts 14. The electrical contacts 14 may be arranged in an array comprised of several rows 24 and columns 26. In the embodiment shown in FIG. 2, the connector insert 10 includes fifteen rows 24 and ten columns 26. Alternatively, the connector insert 10 may include a different number of electrical contacts 14, rows 24 and/or columns 26.

In one embodiment, the connector insert 10 is an electrical connector that complies with the ARINC 600 standard. For example, the connector insert 10 may be an insert configured for use in an Air Transport Rack ("ATR") or Modular Component Unit ("MCU") for line-replaceable electronic units used in aircraft. The connector insert 10 may be referred to as an ARINC connector. In another embodiment, the connector insert 10 is an electrical connector that can mate with one or more other electrical connectors by mating the other electrical connectors with the mating hoods 20 of the electrical contacts 14.

The connector insert 10 may be mounted onto a circuit board (not shown). For example, the loading side 18 may engage the circuit board as the mounting pins 22 of the contacts 14 are inserted into the circuit board to establish an electrical connection between conductive traces (not shown) in the circuit board and the electrical contacts 14. One or more peripheral electrical connectors (not shown) may mate with the connector insert 10 by engaging the mating side 16 and mating with the mating hoods 20 of the contacts 14. Once the peripheral connector is mated with the mating hoods 20, the electrical contacts 14 provide an electronic signal path between the electrical connectors and the circuit board to permit data and/or power signals to be communicated between the peripheral connectors and the circuit board.

Figure 3:
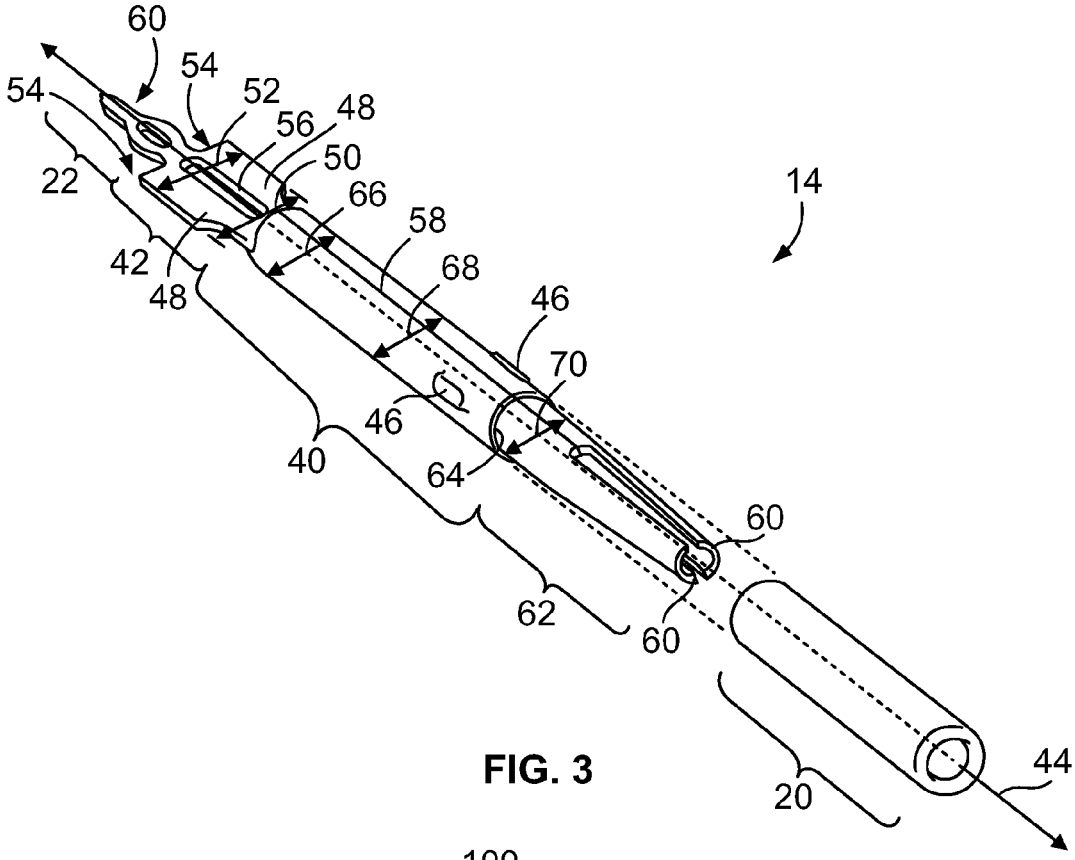
FIG. 3 is an exploded view of an electrical contact shown in FIG. 2.

FIG. 3 is an exploded view of the electrical contact 14. The electrical contact 14 includes an elongated longitudinal contact body 40 that extends between a flange 42 and a mating end 62. The contact body 40 has a substantially cylindrical shape oriented along a longitudinal axis 44. In one embodiment, the interior (not shown) of the contact body 40 is hollow. For example, the contact body 40 may have a tubular shape. The contact body 40 may be formed by bending a flat sheet or ribbon of material around the longitudinal axis 44. A seam 58 in the contact body 40 extends in a direction parallel to the longitudinal axis 44. The seam 58 may be provided when the contact body 40 is formed into the tubular shape shown in FIG. 3. In the illustrated embodiment, the seam 58 extends along the contact body 40 between the flange 42 and the mating end 62. The seam 58 may extend along the contact body 40 in a direction that is substantially parallel to the longitudinal axis 44.

The contact body 40 may include a hood shoulder stop 64 in a location that is proximate to the mating end 62. The hood shoulder stop 64 may contact the mating hood 20 when the mating hood 20 is placed on the mating end 62. The hood shoulder stop 64 may prevent the mating hood 20 from being moved on the mating end 62 and the contact body 40 past the hood shoulder stop 64.

The contact body 40 may have a tapered shape with a diameter that decreases gradually along the longitudinal axis 44 toward the mating side 62. For example, the contact body 40 may have a first outside diameter 66 in a location that is proximate to the flange 42 that is greater than a second outside diameter 68 in a location that is between the hood shoulder stop 64 and the flange 42. A third outside diameter 70 that is located between the hood shoulder stop 64 and the mating end 62 may be less than the first and second outside diameters 66, 68. In one embodiment, the contact body 40 includes one or more retention protrusions 46 that radially extend away from the contact body 40. In the illustrated embodiment, the retention protrusions 46 have a shape that is elongated in a direction parallel to the longitudinal axis 44.

The flange 42 is located between the contact body 40 and the mounting pin 22. In the illustrated embodiment, the flange 42 has a substantially flat surface 48 that is centered along the longitudinal axis 44. The flange 42 has an exterior width 50. In one embodiment, the exterior width 50 is the greatest width of the flange 42 along a transverse axis 52 that is perpendicular to the longitudinal axis 44. The flange 42 includes a pair of shoulders 54 in a location that is proximate to the mounting pin 22. The shoulders 54 include an edge that is parallel to the transverse axis 52.

In the illustrated embodiment, the flange 42 includes an embossed strip 56 that extends along the longitudinal axis 44. The embossed strip 56 may increase the strength of the flange 42 in a direction parallel to the longitudinal axis 44. The embossed strip 56 also may assist in preventing the flange 42 from buckling or bending when a linear force is provided on the shoulders 54 in a direction parallel to the longitudinal axis 44 towards the contact body 40.

The mounting pin 22 is elongated and centered along the longitudinal axis 44 in the illustrated embodiment. The mounting pin 22 includes a compliant eve-of-the-needle tail. In such an embodiment, the mounting pin 22 may be inserted into a circuit board (not shown) by pushing the mounting pin 22 into a cavity (not shown) in the circuit board. For example, the mounting pin 22 may be pushed into a plated through hole (not shown) in the circuit board. In another embodiment, the mounting pin 22 includes a substantially flat pin configured to be soldered to the circuit board. Other pins and contacts may be used as the mounting pin 22 in other embodiments.

The mating end 62 includes contact beams 60 extending from the contact body 40 in a direction parallel to the longitudinal axis 44 and in a direction diametrically opposed to the mounting pin 22. While two contact beams 60 are shown in FIG. 3, a different number of contact beams 60 may be provided.

The contact beams 60 may form a tapered shape that at least partially surrounds the longitudinal axis 44. In one embodiment, the shape of the contact beams 60 decreases in cross-sectional size along the longitudinal axis 44 from the contact body 40 towards the contact beams 60. In one embodiment, the contact beams 60 mate with an electrical contact (not shown) of an electrical connector (not shown) by receiving the electrical contact partially between the contact beams 60. The contact beams 60 may be biased away from one another when the electrical contact is received between the contact beams 60. In another embodiment, the contact beams 60 mate with the electrical contact by inserting the contact beams 60 into a cavity (not shown) in the electrical contact. The contact beams 60 may be biased towards one another when the contact beams 60 are received within the electrical contact.

The mating hood 20 is placed over the mating end 62 and a portion of the contact body 40 to protect the mating end 62 and the contact beams 60 from mechanical damage. The mating hood 20 includes a substantially cylindrical shape that is elongated in a direction parallel to the longitudinal axis 44. The mating hood 20 is hollow, similar to the contact body 40 in one embodiment.

In one embodiment, the mounting pin 22, the flange 42, the contact body 40, and the contact beams 60 are integrally formed with one another. For example, the mounting pin 22, the flange 42, the contact body 40, and the contact beams 60 may be formed from a single sheet (not shown) of material that is formed around the longitudinal axis 44. The mass and weight of the electrical contact 14 may be reduced over known electrical contacts that are created by screw machining the electrical contact from a block of conductive material.

In one embodiment the electrical contact 14 is stamped from a sheet of conductive material, followed by bending the contact body 40 and contact beams 60 around the longitudinal axis 44 while keeping the flange 42 and mounting pin 22 substantially flat. For example, the electrical contact 14 is stamped and formed from a sheet of a conductive material that is approximately 0.008" thick. The conductive material may be a sheet of a copper alloy. By forming the electrical contacts 14 from a sheet of material rather than by screw machining the electrical contacts 14 from a block of material, more highly conductive materials may be used to fabricate the electrical contacts 14 when compared to known electrical contacts that are created through a screw machining process.

The sheet may be plated with a conductive plating layer. For example, the conductive sheet may be plated with nickel. One or more portions of the electrical contacts 14 may be selectively plated with a conductive material. For example, the mating end 62 may be selectively plated with gold while the remainder of the electrical contact 14 is not plated with gold. In another example, the mounting pin 22 may be plated with tin while the remainder of the electrical contact 14 is not plated with tin. In another embodiment the electrical contact 14 may be stamped from a sheet of nonconductive material that is coated or plated with a conductive material. By only plating the mating end 62, the cost of manufacturing the electrical contact 14 may be reduced. Alternatively, the cost of manufacturing the electrical contact 14 may remain approximately the same while permitting the use of a more expensive plating material.

Figure 4:
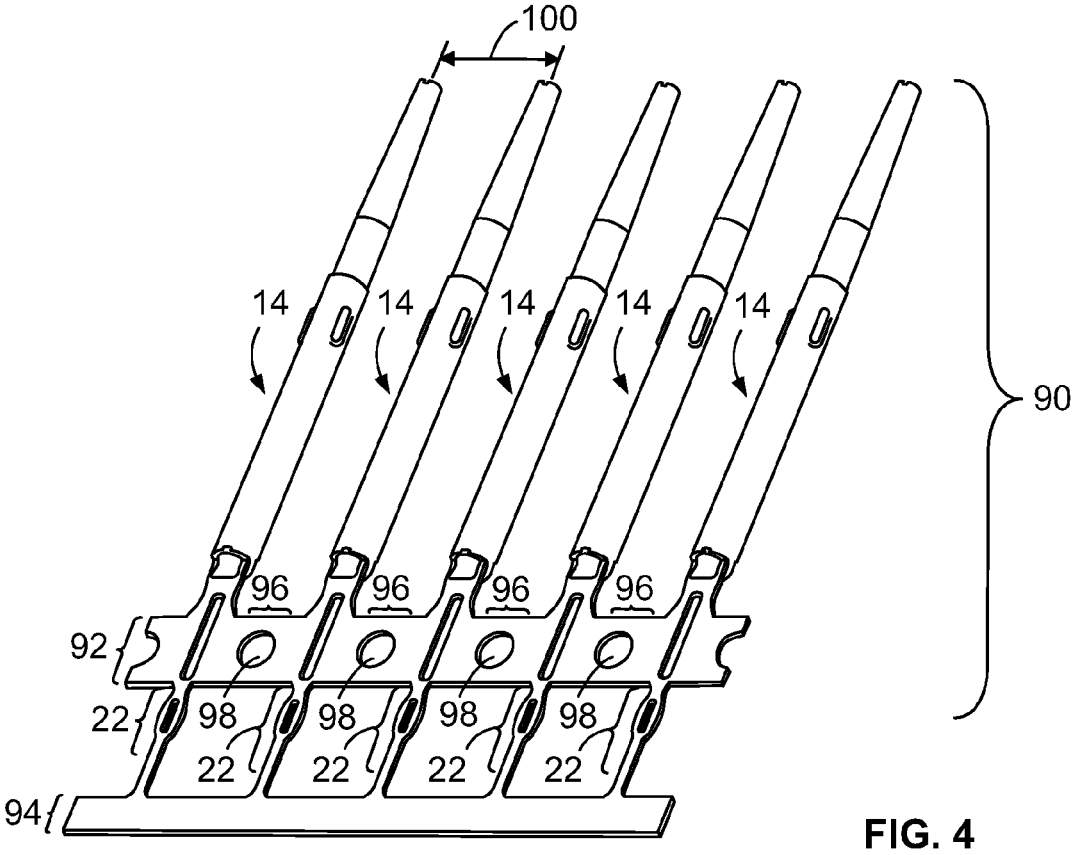
FIG. 4 is a perspective view of an electrical contact assembly comprising a plurality of the electrical contacts shown in FIG. 3.

FIG. 4 is a perspective view of an electrical contact assembly 90 comprising a plurality of electrical contacts 14 after stamping and forming the electrical contacts 14 but prior to inserting the electrical contacts 14 into the connector housing 12 shown in FIG. 2. In the illustrated embodiment, the assembly 90 includes five electrical contacts 14. In other embodiments, a different number of electrical contacts 14 are included in the assembly 90. The electrical contacts 14 in the assembly 90 may be spaced apart from one another by a pitch 100. The electrical contacts 14 may be interconnected with one another by one or more of a center and a rear carrier strip 92, 94 after stamping and forming the electrical contacts 14, but prior to inserting the electrical contacts into the connector housing 12 (shown in FIG. 2).

The center carrier strip 92 is a strip of the sheet of material from which the electrical contacts 14 are stamped and formed. The center carrier strip 92 includes the flanges 42 (shown in FIG. 3) in each of the electrical contacts 14 of the assembly 90 and an interconnect portion 96. The interconnect portion 96 connects the flanges 42 in adjacent electrical contacts 14 in the assembly 90. Each interconnect portion 96 includes a carrier opening 98. The carrier opening 98 may be used to grasp and move the assembly 90 during the process of manufacturing the assembly 90 of electrical contacts 14. For example, the center carrier strip 92 and the carrier openings 98 may be used to grasp and move the assembly 90 from a tool that stamps the electrical contacts 14 from a sheet of material to another tool that forms the contact body 40 (shown in FIG. 3) and the contact beams 62 (shown in FIG. 3), to another tool that selectively plates the mating end 62 (shown in FIG. 3) prior to separating the center carrier strip 92 from the assembly 90. The center carrier strip 92 may be separated from the assembly 90 by cutting the interconnect portion 96 away from between adjacent electrical contacts 14.

The rear carrier strip 94 is a strip of the sheet of material from which the electrical contacts 14 are stamped and formed. The rear carrier strip 94 is connected to each of the mounting pins 22. The rear carrier strip 94 may be used to protect the mounting pins 22 during the process of manufacturing the electrical contacts 14 and inserting the assembly 90 of electrical contacts 14 into the body 12 (shown in FIG. 2). The rear carrier strip 94 may be separated from the assembly 90 by cutting the rear carrier strip 94 from each of the mounting pins 22.

Figure 5:
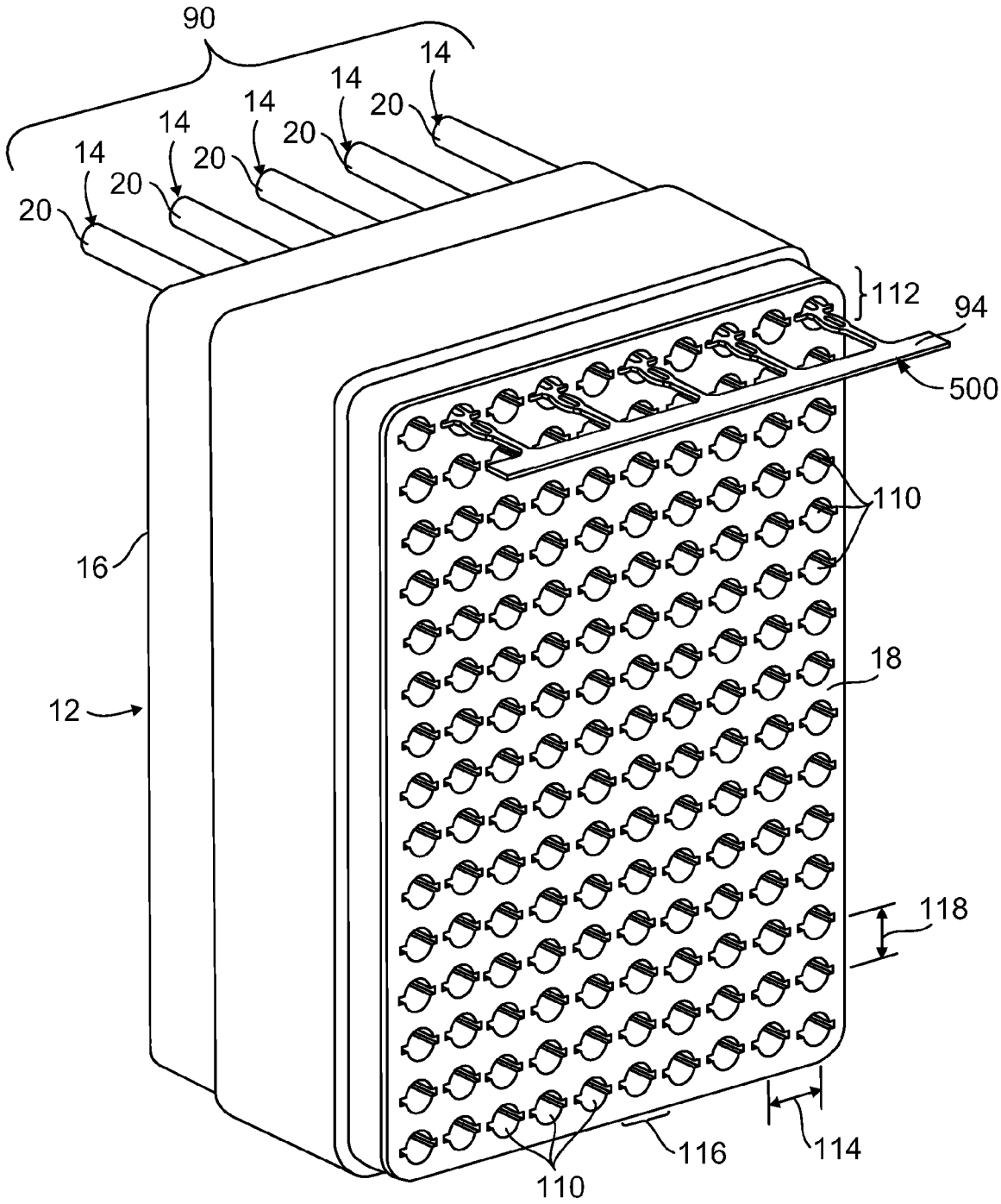
FIG. 5 is a perspective view of the body shown in FIG. 2 with the assembly of electrical contacts shown in FIG. 4 inserted therein.

FIG. 5 is a perspective view of the body 12 with the assembly 90 of electrical contacts 14 inserted therein. In one embodiment once the center carrier strip 92 (shown in FIG. 4) is removed from the assembly 90 of electrical contacts 14, the assembly 90 of electrical contacts 14 may be inserted into corresponding cavities 110 in the body 12. In one embodiment, the mating hoods 20 are placed over the mating ends 62 (shown in FIG. 3) of each electrical contact 14 prior to inserting the assembly 90 of electrical contacts 14 into the cavities 110. The assembly 90 may be inserted by inserting the electrical contacts 14 into the cavities 110 from the loading side 18 of the body 12 along a loading direction 500. The loading direction 500 is oriented approximately perpendicular to the loading side 18 and parallel to the longitudinal axes 44 (shown in FIG. 3) of the contacts 14. In the illustrated embodiment, the assembly 90 of electrical contacts 14 is inserted into every other cavity 110 in a row 112 of cavities 110. For example, the pitch 100 (shown in FIG. 4) of the electrical contacts 14 in the assembly 90 may be approximately twice that of a pitch 114 of the cavities 110 in the row 112. Alternatively, the pitch 100 of the electrical contacts 14 may be a different integer multiple of the pitch 114 of the cavities 110. For example, the pitch 100 may be three or four times that of the pitch 114.

In another embodiment, the assembly 90 of electrical contacts 14 is inserted into ever other cavity 110 in a column 116 of cavities 110. For example, the pitch 100 (shown in FIG. 4) of the electrical contacts 14 in the assembly 90 may be approximately twice that of a pitch 118 of the cavities 110 in the column 116. Alternatively, the pitch 100 of the electrical contacts 14 may be a different integer multiple of the pitch 118 of the cavities 110 in the column 116. For example, the pitch 100 may be three or four times that of the pitch 118.

The rear carrier strip 94 is removed from the electrical contacts 14 in the assembly 90 after the electrical contacts 14 are placed within the corresponding cavities 110. Once the rear carrier strip 94 is removed and prior to mounting the electrical contacts 14 onto a circuit board (not shown) or other device, the electrical contacts 14 are electrically isolated from one another. Another assembly 90 of electrical contacts 14 may then be inserted into corresponding cavities 110 in the body 12. For example, another assembly 90 may be inserted into the cavities 110 in the same row 112 as a previously inserted assembly 90. The time required to insert the electrical contacts 114 in all of the cavities 110 may be greatly decreased by inserting multiple electrical contacts 114 at a time rather than inserting individual electrical contacts 114 one at a time.

In one embodiment, one or more of the electrical contacts 14 may be seated within the cavities 110 after the electrical contacts 14 are inserted into the cavities 110 and the rear carrier strip 94 is removed. For example, a linear force may be applied to the shoulders 54 (shown in FIG. 3) of the electrical contacts 14 in a direction parallel to the longitudinal axis 44 (shown in FIG. 3) in order to seat the electrical contacts 14 in the cavities 110. This linear force may cause the retention protrusions 46 (shown in FIG. 3) to engage an inner surface 136 (shown in FIG. 6) of the corresponding cavity 110 so that an interference, or friction, fit is established between the retention protrusions 46 and the inner surface 136 of the cavity 110. The interference fit between the contacts 14 and the inner surface 136 may prevent the contacts 14 from being fully pushed through the body 12 from the loading side 18 and out of the body 12 through the mating side 16. For example, the interference fit may permit the application of a loading force onto the rear carrier strip 94 in the loading direction 500 to seat the contacts 14 within the cavities 110 while preventing the contacts 14 from being pushed through the cavities 110 in the loading direction 500. The interference fit also may permit the contacts 14 to be removed from the cavities 110 in a direction opposite that of the loading direction 500. For example, the contacts 14 may be removable from the cavities 110 by applying a force onto the hoods 20 in a direction that is opposite that of the loading direction 500. The contacts 14 may be removable without the need or use of any special tools or additional components. For example, as the contacts 14 are secured in the cavities 110 without the use of any contact clips or other components, the contacts 14 may be removed from the cavities 110 without using the tools typically used to release the contact clips or other components.

Figure 6:
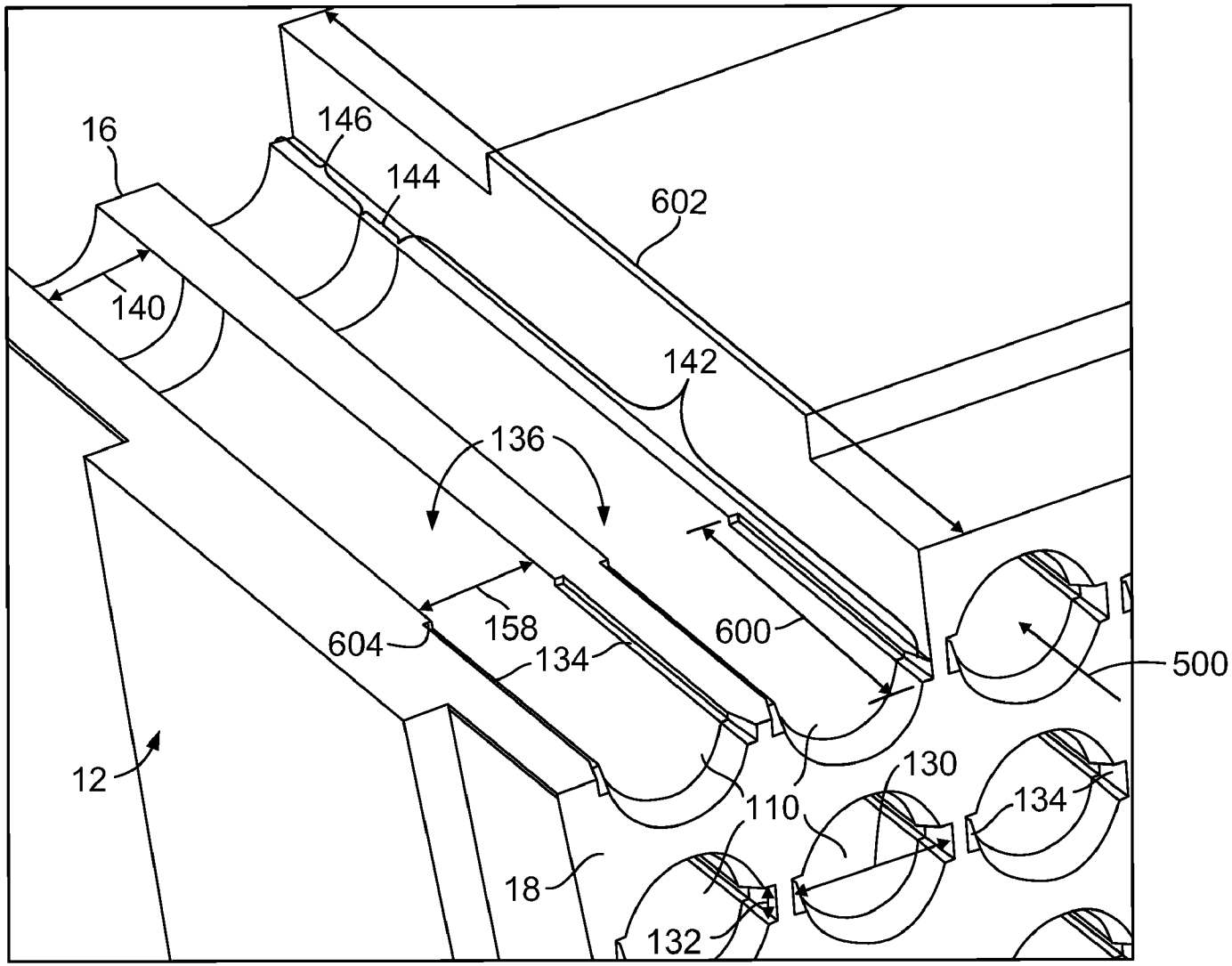
FIG. 6 is a partial cross sectional view of the body shown in FIG. 2 with the contacts removed.

FIG. 6 is a partial cross sectional view of the body 12. As shown in FIG. 6, each of the cavities 110 extends through the body 12 from the mating side 16 to the loading side 18. Slots 134 radially extend from opposite sides of the cavities 110 along the loading side 18. The slots 134 extend into the body 12 along the cavities 110 in the loading direction 500 or in directions parallel to the loading direction 500 from the loading side 18 toward the mating side 16. In the illustrated embodiment the slots 134 extend into the cavities 110 by a slot depth dimension 600. The slots 134 end at corresponding slot shoulder 604. The slot depth dimension 600 is smaller than a thickness dimension 602 of the body 12 that extends from the mating side 16 to the loading side 18 in a direction parallel to the loading direction 500.

A slot width dimension 130 radially spans across the cavity 110 between the two opposite slots 134 of the cavity 110. The slot width dimension 130 is measured in a direction that is perpendicular to the loading direction 500. The slot width dimension 130 is sufficiently large to receive the flange 42 (shown in FIG. 3) of an electrical contact 14 (shown in FIG. 3) in one embodiment. A height dimension 132 of each slot 134 is sufficiently large to receive the flange 42 in one embodiment.

Each cavity 110 includes the inner surface 136. In the illustrated embodiment the inner surface 136 is tapered. For example, the inner surface 136 may have an inside diameter that decreases from a location proximate to the slots 134 to a location proximate to the mating side 16. A first inside diameter 158 of the cavity 110 may be larger than a second inside diameter 140 of the cavity 110. In one embodiment the inner surface 136 is staged in diameter to form three portions: a loading side portion 142, a bezel 144 and a mating side portion 146. The mount loading side portion 142 extends between the loading side 18 and the bezel 144. The mating side portion 146 extends between the mating side 16 and the bezel 144. The loading and mating side portions 142, 146 may have an approximately constant diameter in each respective portion. For example, the loading side portion 142 may have the first inside diameter 158 throughout the loading side portion 142 excluding the slots 134. The mating side portion 146 may have the second inside diameter 140 throughout the mating side portion 146. The bezel 144 may have a gradually changing inside diameter that decreases from the first inside diameter 158 to the second inside diameter 140. In another embodiment, the inner surface 136 is a tapered inner surface with an inside diameter that gradually decreases along the cavity 110 from the loading side 18 to the mating side 16.

The electrical contacts 14 (shown in FIG. 2) may be inserted into the cavities 110 so that the flange 42 (shown in FIG. 3) of each electrical contact 14 is received by the slots 134. The contacts 14 may be seated in the cavities 110 when the flange 42 engages the slot shoulders 604. The slot depth dimension 600 may be varied to adjust the location of the contacts 14 within the cavities 110. For example, increasing the slot depth dimension 600 may cause the contacts 14 to protrude farther from the mating side 16 of the body 12 while decreasing the slot depth dimension 600 may cause the contacts 14 to protrude farther from the loading side 18 of the body 12. The engagement between the flange 42 and the slot 134 impedes or prevents the electrical contact 14 from rotating within the cavity 110 relative to the body 12. The flange 42 may align the electrical contact 14 in the cavity 110.

The electrical contacts 14 are inserted into the cavities 110 until the retention protrusions 46 (shown in FIG. 3) engage the bezel 144. The engagement between retention protrusions 46 and bezel 144 may provide an interference fit that holds the electrical contact 14 in the cavity 110. In another embodiment, the retention protrusions 46 may engage another part of the inner surface 136 to establish an interference fit between the retention protrusions 46 and the inner surface 136. For example, the retention protrusions 46 may engage the inner surface 136 in the mounting side portion 142 or the mating side portion 146. In one embodiment, the retention protrusions 46 engage the inner surface 136 of the cavity 110 to align the electrical contact 14 in the cavity 110. For example, the retention protrusions 46 may engage the bezel 144 so as to center the electrical contact 14 in the cavity 110.

Figure 7:
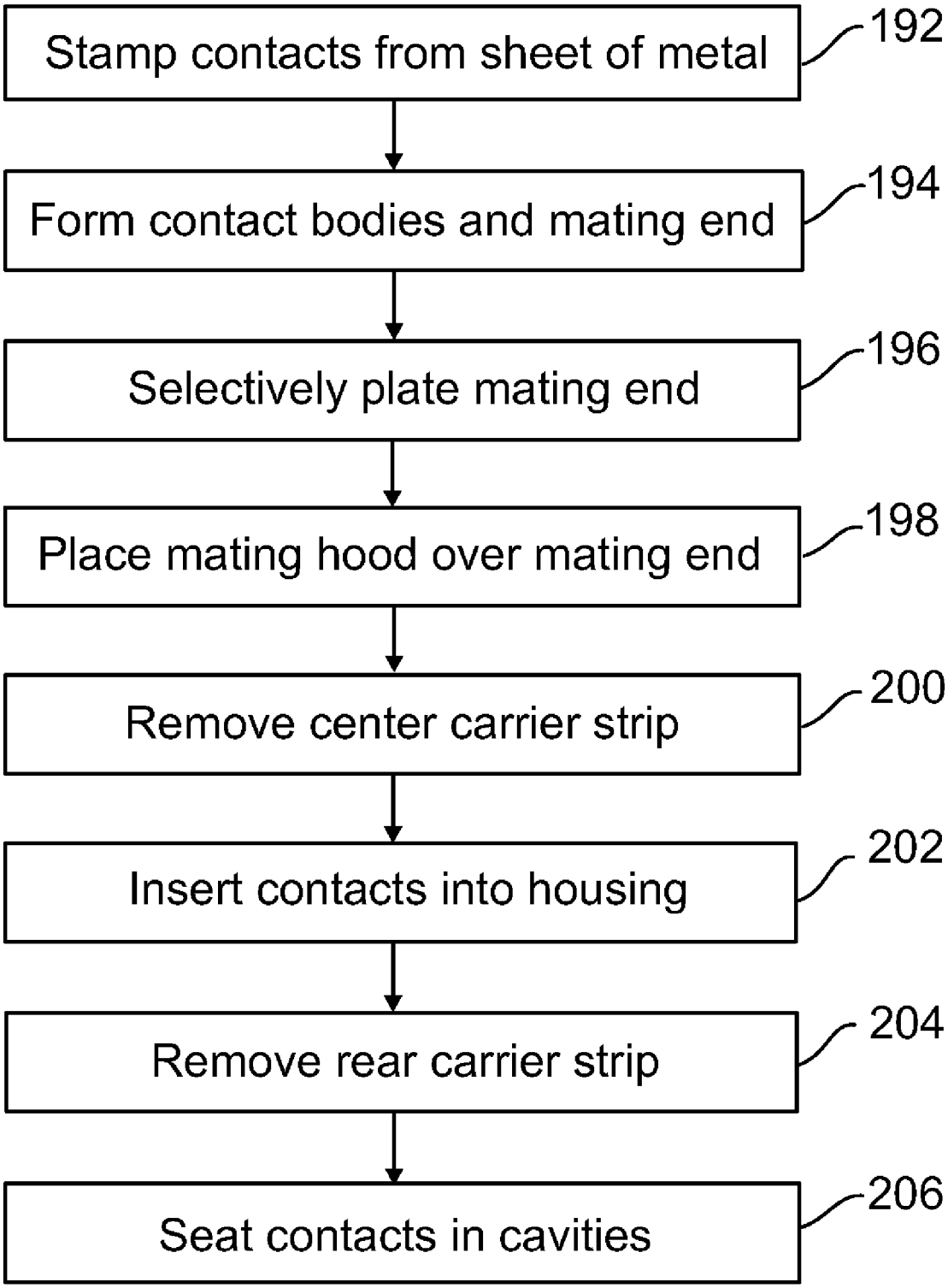
FIG. 7 is a flowchart of a method for manufacturing and seating a plurality of the electrical contacts shown in FIG. 2 in accordance with one embodiment.

FIG. 7 is a flowchart of a method 190 for manufacturing and seating a plurality of the electrical contacts 14 in accordance with one embodiment. At block 192, a plurality of the electrical contacts 14 (shown in FIG. 2) is stamped from a sheet of material. For example, the assembly 90 (shown in FIG. 4) of electrical contacts 14 may be stamped from a flat sheet of material. At block 194, the contact bodies 40 (shown in FIG. 3) and the mating ends 62 (shown in FIG. 3) of the electrical contacts 14 are formed. In one embodiment, the contact bodies 40 and mating ends 62 of each electrical contact 14 are formed by folding or bending the contact bodies 40 and mating ends 62 around the longitudinal axis 44 (shown in FIG. 3) of each electrical contact 14.

At block 196, the mating side 62 of each electrical contact 14 is selectively plated with a conductive material. For example, each mating end 62 may be at least partially covered with a layer of gold. At block 198, the mating hood 20 (shown in FIG. 2) is placed over each of the mating ends 62 of the electrical contacts 14 in the assembly 90. The mating hoods 20 may be placed over the mating ends 62 so that the mating hoods 20 engage the hood shoulder stops 64 (shown in FIG. 3).

At block 200, the center carrier strip 92 (shown in FIG. 4) is removed from the assembly 90 of electrical contacts 14. At block 202, each of the electrical contacts 14 in the assembly 90 is inserted into one of the cavities 110 (shown in FIG. 5) of the body 12 (shown in FIG. 2). The electrical contacts 14 may be inserted by exerting a linear force on the rear carrier strip 94 (shown in FIG. 4) in a direction parallel to the longitudinal axes 44 of the electrical contacts 14. At block 204, the rear carrier strip 94 is removed from the assembly 90 of electrical contacts 14. At block 206, the electrical contacts 14 that were inserted into the cavities 110 at step 202 are seated in the cavities 110 by applying a linear force to the shoulders 54 (shown in FIG. 3) of the electrical contacts 14. The linear force may be applied in a direction parallel to the longitudinal axis 44 of each electrical contact 14. In one embodiment the electrical contacts 14 are seated once the retention protrusions 46 (shown in FIG. 3) engage the inner surface 136 (shown in FIG. 6) of the cavities 110.

In one embodiment block 198 occurs after block 200. For example, the mating hoods 20 may not be placed over the mating ends 62 of the electrical contacts 14 (block 198) until after the center carrier strip 92 is removed from the assembly 90 of electrical contacts 14 (block 200). Optionally, block 206 is omitted from the method 190. For example, seating the electrical contacts 14 in the cavities 110 (block 206) may not be necessary if the retention protrusions 46 engage the inner surface 136 of the cavities 110 at block 202.

Figure 8:
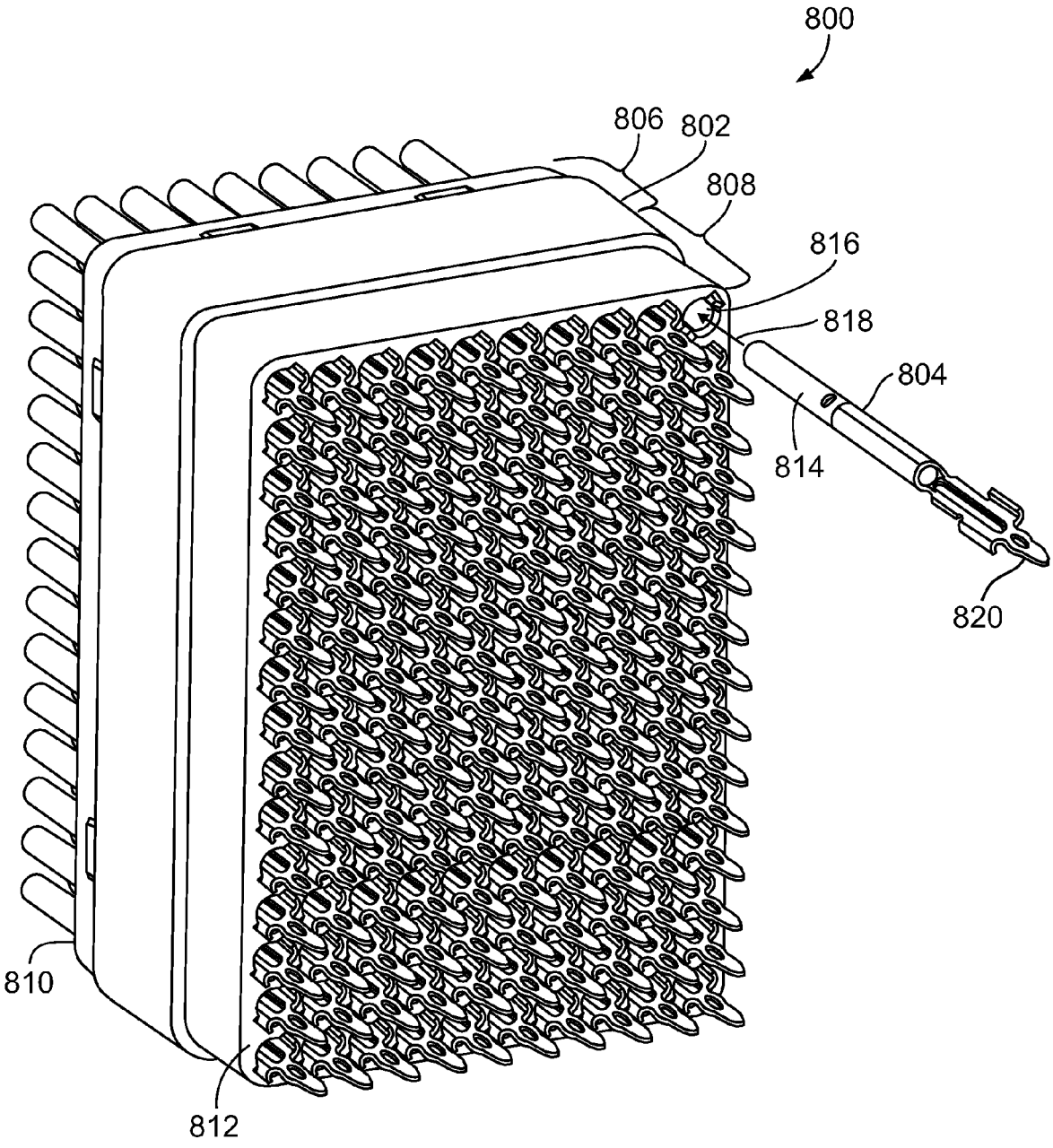
FIG. 8 is a perspective view of a connector insert according to an alternative embodiment.

FIG. 8 is a perspective view of a connector insert 800 according to an alternative embodiment. The connector insert 800 includes a unitary body 802 that holds several electrical contacts 804. The body 802 is formed of a single piece of material in one embodiment. For example, the body 802 may be molded as a single piece of dielectric material. In one embodiment, the body 802 is homogeneously formed as a single unitary body. Alternatively, the body 802 is divided into two or more pieces that are joined together. For example, the body 802 may include a mating section 806 and a mounting section 808 that are separately formed and secured together using one or more latches, threaded connections adhesives, and the like. The body 802 extends between opposite mating and loading sides 810, 812. In the illustrated embodiment the mating and loading sides 810, 812 are in a parallel relationship with respect to one another. In one embodiment, the connector insert 800 is an electrical connector that complies with the ARINC 600 standard.

The contacts 804 protrude from each of the mating and loading sides 810, 812. The contacts 804 extend from the mating side 810 to engage and mate with one or more peripheral connectors (not shown). The contacts 804 extend from the loading side 812 to engage and mate with a substrate (not shown), such as a circuit board. The contacts 804 provide conductive pathways between the peripheral connectors and substrate to permit communication of data and/or power signals between the peripheral connectors and substrate.

A mating hood 814 of each contact 804 protrudes from the mating side 810. Similar to the mating hoods 20 (shown in FIG. 2), the mating hoods 814 are tube or cylinder-shaped components that extend from the mating side 810 in directions that are approximately perpendicular to the mating side 810. The mating hoods 814 engage the peripheral connectors (not shown) to electrically couple the peripheral connectors and the contacts 804. A mounting pin 820 of each contact 804 protrudes from the loading side 812. The mounting pins 820 are inserted into cavities (not shown) in a circuit board (not shown) to electrically couple the contacts 804 with the circuit board.

The body 802 includes cavities 816 that extend through the body 802 from the mating side 810 to the loading side 812. Similar to the cavities 110 (shown in FIG. 5), the contacts 804 are loaded into the cavities 816 along a loading direction 818. In the illustrated embodiment, the loading direction 818 is oriented perpendicular to the loading side 812 and the mating side 810. The contacts 804 may be retained in the cavities 816 in a manner similar to the contacts 14 (shown in FIG. 2) described above. For example, the contacts 804 may be secured in the cavities 816 through an interference fit that prevents the contacts 804 from being removed from the body 802 through the mating side 810 but permits the contacts 804 to be removed from the body 802 through the loading side 812.

Figure 9:
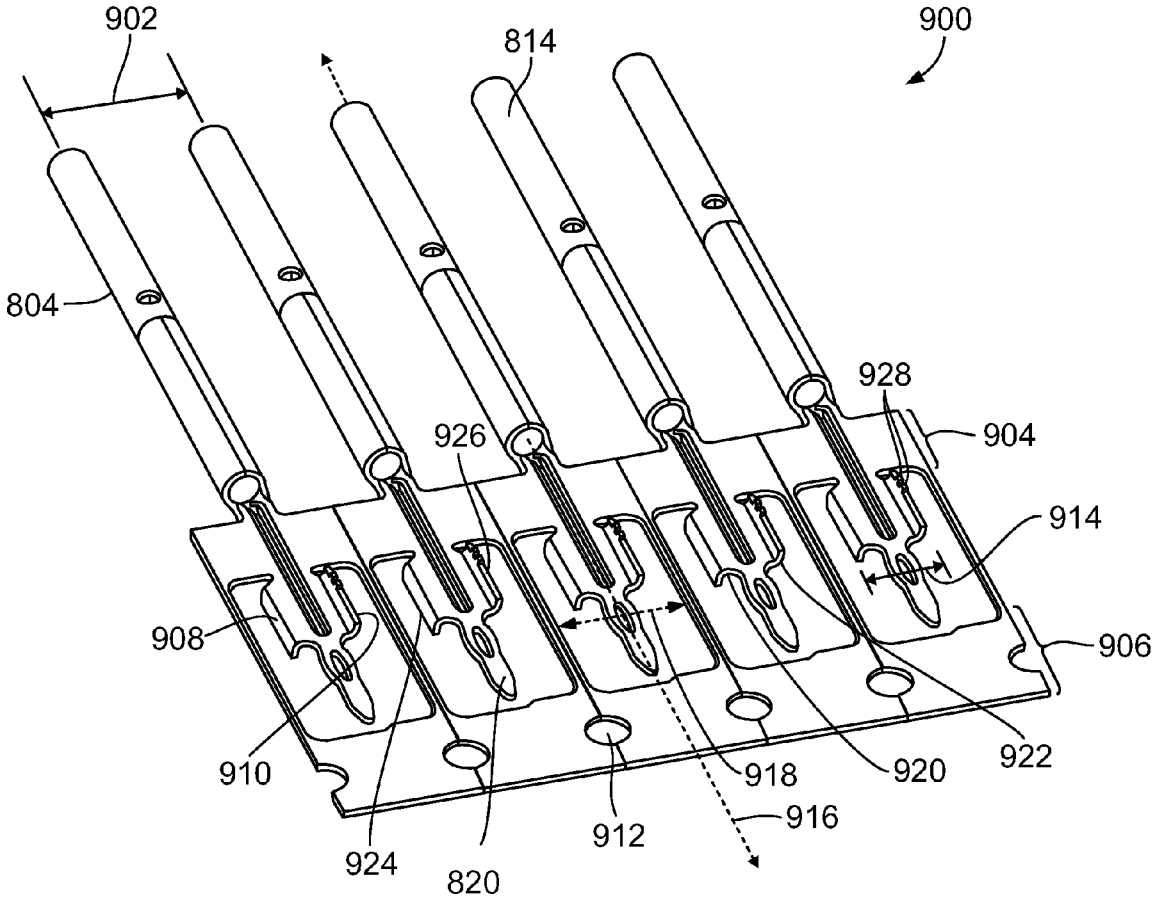
FIG. 9 is a perspective view of an electrical contact assembly according to an alternative embodiment.

FIG. 9 is a perspective view of an electrical contact assembly 900 according to an alternative embodiment. The contact assembly 900 includes several interconnected contacts 804 similar to the contact assembly 90 (shown in FIG. 4). The contacts 804 may be similar to the contacts 14 (shown in FIG. 2) and have contact bodies and beams that are similar to the contact bodies 40 (shown in FIG. 3) and contact beams 62 (shown in FIG. 3) of the contacts 14. Each of the contacts 804 is elongated and is oriented along a longitudinal axis 916. The contacts 804 are spaced apart from one another by a contact pitch 902. The contacts 804 are interconnected with one another by center and rear carrier strips 904, 906. Similar to the contact assembly 90, the contact assembly 900 may be stamped and formed from a common sheet of conductive material, with the hoods 814 loaded onto the contacts 804.

Each of the center carrier strip 904 and the rear carrier strip 906 is a strip of the sheet of material from which the contacts 804 are stamped and formed. Flanges 908, 910 of the each of the contacts 804 are coupled with the center carrier strip 904 and are located between the center and rear carrier strips 904, 906. The flanges 908, 910 extend from the contacts 804 to engagement surfaces 924, 926 in opposite directions that are angled with respect to the longitudinal axes 916 of the contacts 804. For example, the flanges 908, 910 may protrude from the contact 804 in directions that are perpendicular to the longitudinal axis 916. In the illustrated embodiment, the flanges 908, 910 are bent or curved in opposite directions. For example, the flange 908 is bent downward with respect to the perspective of FIG. 9 while the flange 908 is bent upward. Alternatively, the flanges 908, 910 may be curved in other directions or may be shaped similar to the flanges 92 (shown in FIG. 4) of the contacts 14 (shown in FIG. 2). The curvature of the flanges 908, 910 may make the flanges 908, 910 more resistant to buckling or bending when the contacts 804 are loaded into the cavities 816 (shown in FIG. 8) of the body 802 (shown in FIG. 8). The flanges 908, 910 have an exterior width dimension 914 that is measured in a direction parallel to a transverse axis 918 of the contacts 804. In one embodiment, the exterior width 914 is the greatest width of the flanges 908, 910 along the transverse axis 918. The transverse axis 918 is perpendicular with respect to the longitudinal axis 916. The width dimension 914 of the flanges 908, 910 is greater than the width dimension 50 (shown in FIG. 3) of the contacts 14. The pins 820 are joined with the flanges 908, 910 and located between the flanges 908, 910 and the rear carrier strip 906.

The flanges 908, 910 include the oppositely facing engagement surfaces 924, 926. The engagement surface 924 of the flange 908 faces downward and the engagement surface 926 of the flange 910 faces upward. The engagement surfaces 924, 926 are edges in the illustrated embodiment. The engagement surfaces 924, 926 include flange protrusions 928 that extend from the engagement surfaces 924, 926 in opposite directions. For example, the flange protrusions 928 of the engagement surface 926 protrudes from the engagement surface 926 in a direction that is opposite to the direction that the flange protrusions 928 extend from the engagement surface 924. While two flange protrusions 928 are shown on each engagement surface 924, 926, a different number of flange protrusions 928 may be provided.

The flange protrusions 928 secure the contacts 804 in the cavities 816 (shown in FIG. 8). The flange protrusions 928 engage the body 802 (shown in FIG. 8) of the connector insert 800 (shown in FIG. 8) inside the cavities 816. The engagement between the flange protrusions 928 and the inner surface of the body 802 inside the cavities 816 increases the interference fit between the contacts 804 and the body 802. For example, the flange protrusions 928 may increase the amount of a removal force that is required to be applied to the contacts 804 to remove the contacts 804 from the cavities 816 in a direction that is opposite of the loading direction 818 (shown in FIG. 8).

The rear carrier strip 906 includes several carrier openings 912. Similar to the carrier openings 98 (shown in FIG. 4), the carrier openings 912 may be used to grasp and move the assembly 900 during the process of manufacturing the assembly 900. For example, the rear carrier strip 906 and the carrier openings 912 may be used to grasp and move the assembly 900 from a tool that stamps the contacts 804 from a sheet of material to another tool that forms the contacts 804, to another tool that selectively plates one or more portions of the contacts 804 in a manner similar to the contacts 14 (shown in FIG. 2) prior to separating the center carrier strip 904 from the assembly 900. The center carrier strip 904 may be separated from the assembly 900 by cutting portions of the center carrier strip 904 away from between adjacent contacts 804.

The rear carrier strip 906 is a strip of the sheet of material from which the contacts 804 are stamped and formed. The rear carrier strip 906 is connected to each of the contacts 804 and is used to move the contacts 804 during stamping, forming and selective plating of the contacts 804. The rear carrier strip 904 may be separated from the assembly 900 by cutting the rear carrier strip 904 from each of the contacts 804 prior to loading the contacts 804 into the cavities 816 (shown in FIG. 8).

A force may be applied to the flanges 908, 910 along the loading direction 818 (shown in FIG. 8) to press the contacts 804 into the cavities 816 and to establish an interference fit between the contacts 804 and the connector insert 800, similar to as described above. For example, the flanges 908, 910 may include shoulders 920, 922 that are edges of the flanges 908, 910 on which the force may be applied to seat the contacts 804 in the cavities 816.

Figure 10:
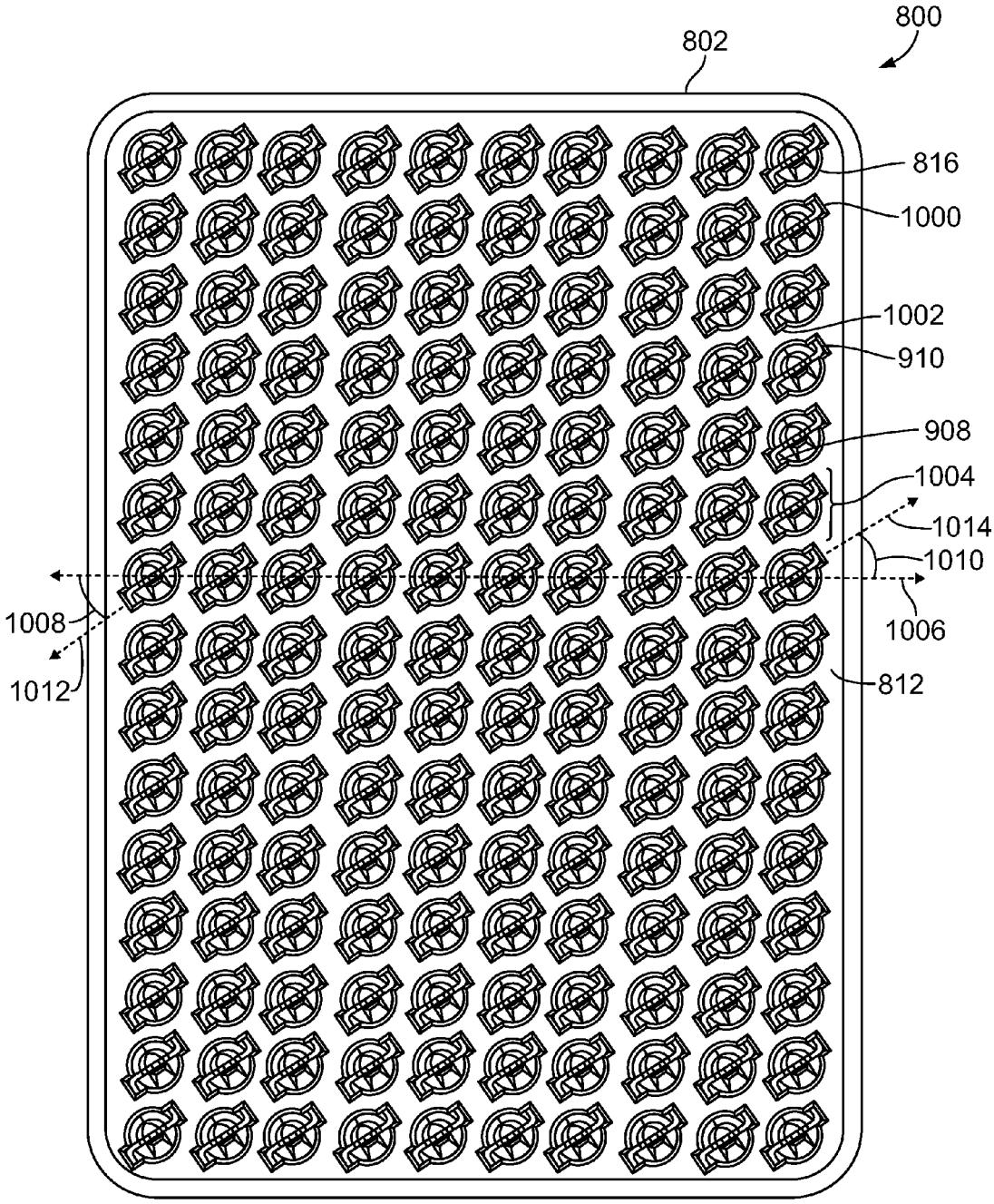
FIG. 10 is an elevational view of the connector insert shown in FIG. 8 in accordance with one embodiment.

FIG. 10 is an elevational view of the connector insert 800 in accordance with one embodiment. As shown in FIG. 10, the cavities 816 include slots 1000, 1002 extending in opposite directions from approximately opposite sides of the cavities 816. The slots 1000, 1002 may be similar to the slots 134 (shown in FIG. 6). For example, the slots 1000, 1002 may be shaped to receive the flanges 908, 910. One difference between the slots 1000, 1002 and the slots 134 is the angled orientation of the slots 1000, 1002. As shown in FIG. 5, the slots 134 are linearly aligned with respect to one another. For example, the slots 134 of the cavities 110 in one row 112 of cavities 110 are disposed along a common axis or direction.

In contrast, the slots 1000, 1002 of the cavities 816 are not linearly aligned with one another. For example, the slots 1000, 1002 of the cavities 816 in one row 1004 of cavities 816 are offset and out of linear alignment with one another. With respect to a center axis 1006 that extends along the loading side 812 of the connector insert 800 and through the centers of the cavities 816 at the loading side 812, the slots 1000 are angled above the center axis 1006 at a first angle 1010 and the slots 1002 are angled below the center axis 1006 at a second angle 1008. For example, the slots 1002 of the cavities 816 in one row 1004 are oriented along a direction 1012 that is disposed at the first angle 1008 with respect to the center axis 1006 of the cavities 816 in the row 1004. The slots 1000 in the same row 1004 are oriented along a direction 1014 that is disposed at the second angle 1010 with respect to the center axis 1006. The first and second angles 1008, 1010 may be approximately the same or may differ from one another.

The slots 1000, 1002 are angled with respect to one another to provide increased separation between the slots 1000, 1002 along the loading side 812. For example, the slots 1000, 1002 of adjacent cavities 816 are separated by a greater distance along the loading side 812 than the slots 134 of the connector insert 12 (shown in FIG. 6). Increasing the distance between the slots 1000, 1002 of adjacent cavities 816 may increase the strength of the bode 802 and/or reduce the complexity and cost of manufacturing the body 802. For example, increasing the separation between the slot 1000 of one cavity 816 and the slot 1002 of an adjacent cavity 816 may reduce the complexity and/or cost of molding the body 802. As shown in FIG. 10, the slots 1000, 1002 are shaped to receive the curved flanges 908, 910 of the contacts 804. For example, the slots 1000 receive the upward curved flanges 910 while the slots 1002 receive the downward curved flanges 908. The contacts 804 may be received and secured in the cavities 816 in a manner similar to the receipt of the contacts 14 (shown in FIG. 2) into the cavities 110 (shown in FIG. 5).

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector insert comprising:

a unitary body extending between mating and loading sides, the loading side configured to engage a circuit board to mate the body with the circuit board, the mating side configured to mate with a peripheral connector to electrically couple the circuit board with the peripheral connector, the body including a cavity extending through the body from the mating side to the loading side and slots extending partially into the housing alongside the cavity from the loading side of the body toward the mating side of the body; and a contact held in the cavity of the body, the contact including a mating end protruding from the mating side of the body to engage the peripheral connector and a mounting pin protruding from the loading side of the body to engage the circuit board, the contact providing an electronic signal path between the circuit board and the peripheral connector, the contact having a flange having a flat portion that extends between opposite engagement surfaces of the flange that are curved in opposite directions, the flange and the engagement surfaces received in the slots, wherein the contacts are loaded into the cavity through the loading side and retained in the body by an interference fit between the engagement surfaces of the flanges and the body, further wherein the interference fit prevents the contact from being removed from the body through the mating side.

2. The connector insert of claim 1, wherein an inner surface of the cavity is tapered such that an inside diameter of the cavity in a location proximate to the loading side of the body is greater than an inside diameter of the cavity in a location proximate to the mating side of the body.

3. The connector insert of claim 1, wherein the contact is stamped and formed from a common sheet of a first conductive material and selectively plated with a second conductive material.

4. The connector insert of claim 1, wherein an inner surface of the cavity in the body has a tapered shape that decreases in inside diameter from the loading side of the body to the mating side of the body.

5. The connector insert of claim 1, wherein the body includes a plurality of the cavities and the cavities are arranged in the body and configured to hold a plurality of the contacts to mate with an ARINC standard connector.

6. The connector insert of claim 1, wherein the flat portion and the curved engagement surfaces of the flange form an S-shape.

7. A connector insert comprising:

a unitary body extending between opposite mating and loading sides, the mating side configured to engage peripheral connectors and the loading side configured to engage a circuit board, the body including cavities that longitudinally extend through the body from the mating side to the loading side and that include inner surfaces, the body also including slots laterally extending through the body along opposite sides of each of the cavities; and elongated contacts disposed in the cavities and oriented along longitudinal axes between opposite mating and mounting ends, at least one of the contacts including a flange having a flat portion between opposite engagement ends that are curved in opposite directions and that are received in the slots in the body, wherein the engagement surfaces of the flange include flange protrusions extending from the engagement surfaces to secure the at least one of the contacts in the cavity by an interference fit.

8. The connector insert of claim 7, wherein the contacts are stamped and formed from a common sheet of a first conductive material and the mating ends of the contacts are selectively plated with a second conductive material.

9. The connector insert of claim 7, wherein the contacts comprise retention protrusions radially projecting from the contacts and configured to engage the inner surfaces of the cavities to secure the contacts in the cavities.

10. The connector insert of claim 7, wherein the slots in the body radially extend from the cavities along directions that are not collinear with respect to each other.

11. The connector insert of claim 7, wherein each of the contacts is tapered from a greater outside diameter proximate the mounting end to a lesser outside diameter proximate the mating end.

12. The connector insert of claim 7, wherein the inner surfaces of the cavities have tapered shapes that decrease in diameter from the loading side to the mating side of the body.

13. The connector insert of claim 7, wherein the cavities are arranged in the body and configured to hold the contacts to mate with an ARINC connector.

14. The connector insert of claim 7, wherein the contacts have tubular shapes.

15. The connector insert of claim 7, wherein the flat portion and the curved engagement surfaces of the flange form an S-shape.

* * * * *